US006648441B2

(12) United States Patent
Naoi

(10) Patent No.: US 6,648,441 B2
(45) Date of Patent: Nov. 18, 2003

(54) PRINTING APPARATUS AND POWER CONSUMPTION REDUCTION METHOD OF PRINTING APPARATUS

(75) Inventor: Masaaki Naoi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/984,750

(22) Filed: Oct. 31, 2001

(65) Prior Publication Data

US 2002/0051024 A1 May 2, 2002

(30) Foreign Application Priority Data

Nov. 2, 2000 (JP) ..... 2000-336611

(51) Int. Cl.[7] ..... B41J 29/38

(52) U.S. Cl. ..... 347/13; 347/14; 347/41; 347/42

(58) Field of Search ..... 347/12.15, 41, 347/13, 42, 43, 14

(56) References Cited

U.S. PATENT DOCUMENTS

| | | | | |
|---|---|---|---|---|
| 4,313,124 A | | 1/1982 | Hara | 340/140 |
| 4,345,262 A | | 8/1982 | Shirato et al. | 346/140 |
| 4,459,600 A | | 7/1984 | Sato et al. | 346/140 |
| 4,463,359 A | | 7/1984 | Ayata et al. | 346/1.1 |
| 4,558,333 A | | 12/1985 | Sugitani et al. | 346/140 |
| 4,608,577 A | | 8/1986 | Hori | 346/1.1 |
| 4,723,129 A | | 2/1988 | Endo et al. | 346/1.1 |
| 4,740,796 A | | 4/1988 | Endo et al. | 346/1.1 |
| 6,193,358 B1 | * | 2/2001 | Fujita et al. | 347/41 |
| 6,238,034 B1 | * | 5/2001 | Ono | 347/9 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |

* cited by examiner

*Primary Examiner*—Judy Nguyen
*Assistant Examiner*—Lam Nguyen
(74) *Attorney, Agent, or Firm*—Fitzpatrick, Cella, Harper & Scinto

(57) ABSTRACT

A printing apparatus, comprising a plurality of full-line-type printheads having an array of printing elements corresponding to a width of a print medium, calculates the number of pixels to be printed in a predetermined region, obtains a value related to power to be supplied to the printheads based on the number of pixels, determines whether or not the value related to power is larger than a predetermined value, and if the value related to power is larger than the predetermined value, performs thinning on pixels to be printed in a predetermined region so as to keep the value related to power under the predetermined value, thereby reducing power consumption without decreasing printing speed.

18 Claims, 6 Drawing Sheets

PRINTING APPARATUS AND POWER CONSUMPTION REDUCTION METHOD OF PRINTING APPARATUS

FIELD OF THE INVENTION

The present invention relates to a printing apparatus and a power consumption reduction method of a printing apparatus and, more particularly, to a printing apparatus comprising a plurality of full-line-type printheads having an array of printing elements corresponding to a width of a print medium, and a power consumption reduction method of a printing apparatus.

BACKGROUND OF THE INVENTION

Data output apparatuses employed by, for instance, word processors, personal computers, facsimiles or the like, include a printer for printing desired data, e.g., characters, images or the like, on a sheet-type print medium, such as paper, film or the like.

Although various methods are known for a printing method of the printer, recently an ink-jet printing method has particularly brought attention for the following reasons: ability to print without contacting a print medium such as paper, low running cost, easy color printing, low-noise operation because of its non-impact method, and so on.

Among ink-jet printing apparatuses, a widely used printing apparatus is a full-line-type printing apparatus capable of further increasing printing speed, which comprises a printhead having an array of printing elements (nozzles) corresponding to a printing area, and performs printing while conveying a print medium.

When color printing is performed by the full-line-type printing apparatus, a plurality of printheads for discharging different colors of ink are arranged in a conveyance direction of a print medium and ink is simultaneously discharged from each of the printheads so as not to decrease printing speed of the color printing.

However, because such full-line-type printing apparatus simultaneously drives a large number of nozzles, it generates a problem of large power consumption.

For instance, assuming that printing is performed at resolution of 600 dpi (600 dots per inch) with a maximum printing width, corresponding to the long side of a generally used A4-size (210 mm×297 mm) print medium, the printhead will have approximately 7000 nozzles.

A color printing apparatus using six types of ink, e.g., black, cyan, magenta, yellow, light cyan, light magenta and so on, comprises six of the aforementioned printheads. Discharging ink from each nozzle requires a driving voltage of 15V and a current of 100 mA applied for 1 $\mu$S. In a case where each printhead is driven in a cycle of 62.5 $\mu$S, the maximum power consumption value is:

$$(15V\times100\ mA)\times(1\ \mu S/62.5\ \mu S)\times7000\times6=1008\ W\doteq1\ kW.$$

In reality, the printing apparatus further requires power consumed by other electric circuits and motors or the like. Therefore, the maximum power consumption value of the printing apparatus as a whole is one thousand and several hundreds watts.

When the maximum power consumption value exceeds 1 kW, it is difficult to use the printing apparatus and other electrical equipment on the same power supply path, thus a dedicated power supply path is necessary for the printing apparatus. This limits the location of installation or form of utilization, thus causing inconvenience to users.

SUMMARY OF THE INVENTION

The present invention has been proposed in view of the above problems, and has as its object to provide a printing apparatus capable of reducing power consumption without decreasing printing speed, and provide a power consumption reduction method of a printing apparatus.

To achieve the above object, the present invention provides a printing apparatus including a plurality of full-line-type printheads having an array of printing elements corresponding to a width of a print medium, comprising: pixel number calculation means for calculating a number of pixels to be printed in a predetermined region; print power calculation means for calculating a value related to power to be supplied to the printhead based on the number of pixels; determination means for determining whether or not the value related to power is larger than a predetermined value; and thinning means for thinning a pixel to be printed in the predetermined region so as to keep the value related to power under the predetermined value, if the determination means determines that the value related to power is larger than the predetermined value.

More specifically, the printing apparatus, including a plurality of full-line-type printheads having an array of printing elements corresponding to a width of a print medium, calculates a number of pixels to be printed in a predetermined region; calculates a value related to power to be supplied to the printhead based on the number of pixels; determines whether or not the value related to power is larger than a predetermined value; and performs thinning on a pixel to be printed in the predetermined region so as to keep the value related to power under the predetermined value, if the value related to power is determined to be larger than the predetermined value.

By virtue of the present invention, the maximum power consumption value is kept under a predetermined value without decreasing printing speed. Therefore, the suppliable maximum power of a power source can be set smaller than a conventional value, and a power source device can be downsized.

Accordingly, the entire printing apparatus can be downsized, decreased in weight, and lowered in cost. Furthermore, since the amount of heat generated in the printing operation is decreased, heat produced by a printing apparatus is decreased, thus reducing adverse effects on the environment of the apparatus, such as temperature increase and so forth. Moreover, less power consumption contributes to energy conversation.

According to the present invention, it is preferable that the printing apparatus further comprises image memory for storing input image data, and that the pixel number calculation means calculates the number of pixels based on the image data inputted to the image memory, or based on the image data read out of the image memory.

Furthermore, it is preferable that the thinning means thin out a pixel to be printed in accordance with a predetermined mask pattern.

In this case, it is preferable that the mask pattern used by the thinning means be selectable from a plurality of mask patterns.

Moreover, the value related to power can be calculated based on the number of pixels to be printed for each printhead and a power consumption value consumed to drive one printing element in each printhead.

In this case, the power consumption value consumed to drive one printing element may be different in printheads.

Further, if a plurality of power supply units (power supply voltages) are provided, the value related to power can be calculated for each unit of power supply.

Moreover, the present invention is applicable in a case where the pixels are to be printed on different printing media by a plurality of printheads in a predetermined time period.

Furthermore, in order to achieve the above object, the present invention provides a power consumption reduction method of a printing apparatus, which has a plurality of full-line-type printheads having an array of printing elements corresponding to a width of a print medium, comprising: a pixel number calculation step of calculating a number of pixels to be printed in a predetermined region; a print power calculation step of calculating a value related to power to be supplied to the printhead based on the number of pixels; a determination step of determining whether or not the value related to power is larger than a predetermined value; and a thinning step of thinning a pixel to be printed in the predetermined region so as to keep the value related to power under the predetermined value, if the value related to power is determined to be larger than the predetermined value at the determination step.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In this specification, "print" means not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

[First Embodiment]

Figure 4:
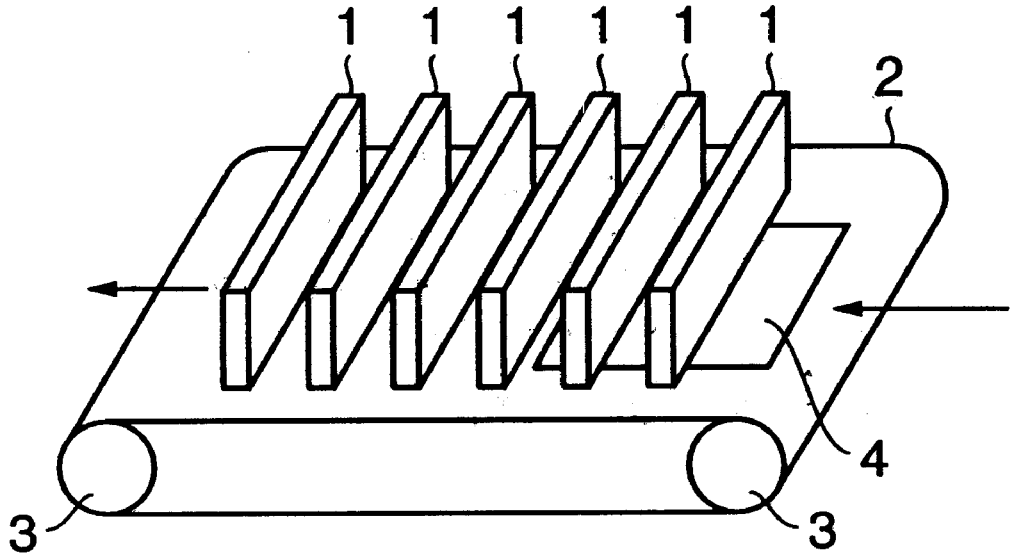
FIG. 4 is a view showing a brief construction related to printing in an ink-jet printing apparatus according to the present invention.

FIG. 4 shows a brief construction related to printing in an ink-jet printing apparatus according to the first embodiment of the present invention.

Referring to FIG. 4, reference numeral 1 denotes printheads discharging ink; 2, a conveyance belt conveying a print medium; 3, conveyance rollers moving the conveyance belt; and 4, a print medium.

Each printhead 1 comprises an array of nozzles, having a width corresponding to a maximum print width in a direction orthogonal to the print medium conveyance direction. The printheads are so constructed that they respectively discharge different colors of ink on a print medium. The first embodiment comprises six printheads for printing in six colors (black, cyan, magenta, yellow, light cyan, and light magenta).

Figure 5:
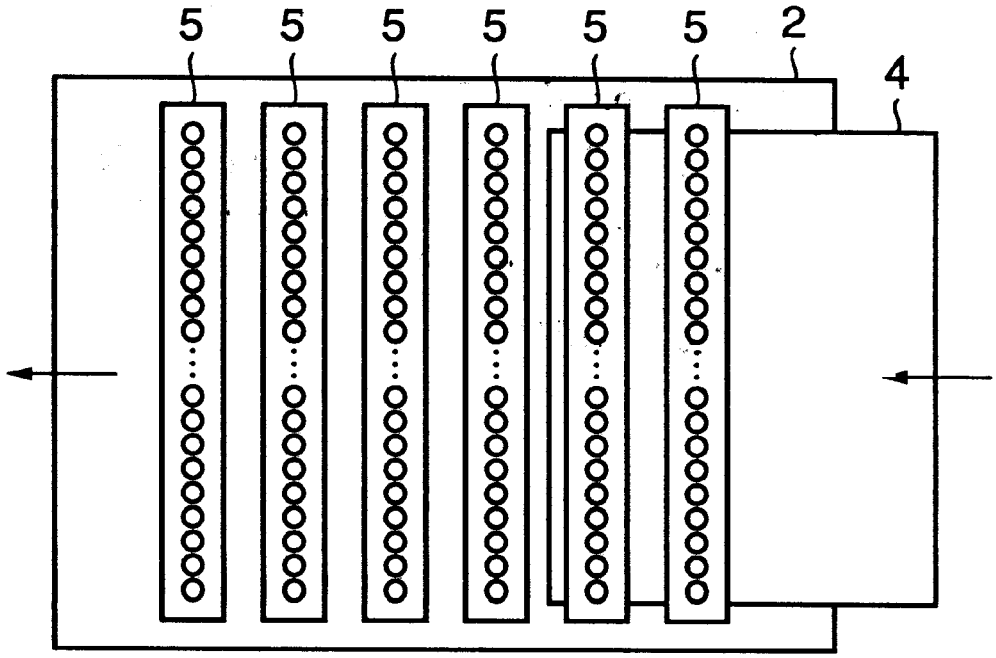
FIG. 5 is a diagrammatic top view of the printing apparatus shown in FIG. 4.

FIG. 5 is a diagrammatic top view of the printing apparatus shown in FIG. 4. Reference numeral 5 denotes the nozzle arrays of the printheads 1 which discharge ink. In each nozzle, a heat generating element as a printing element for discharging ink is provided. Although the nozzles are shown in the upper side of the printhead in FIG. 5, in reality, the nozzles are provided on the surface facing the print medium 4.

In the foregoing configuration, printing is performed by the nozzle array 5 of each printhead 1, which discharges ink onto a print medium according to print data, while the print medium 4 is conveyed by the conveyance belt 2 from right to left as indicated by the arrows in FIGS. 4 and 5.

Hereinafter, the method of reducing power consumption in the ink-jet printing apparatus of the first embodiment is described.

Figure 1:
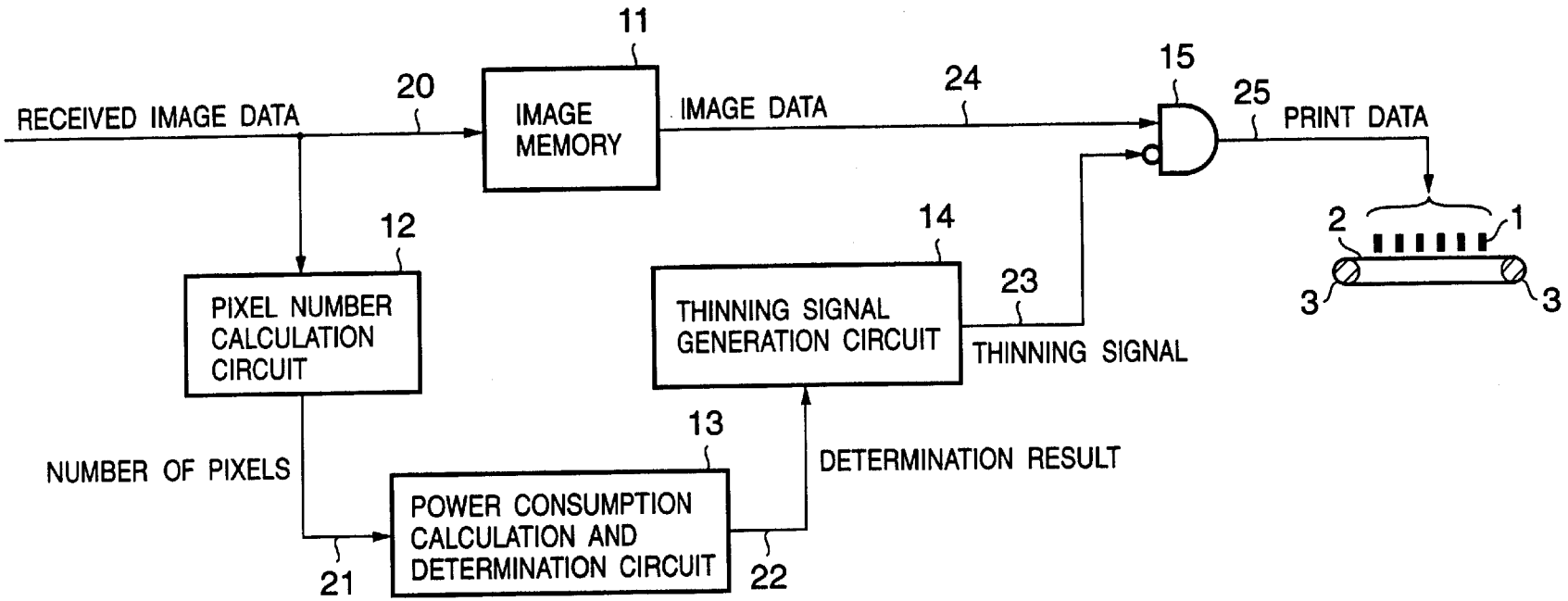
FIG. 1 is a block diagram showing a construction and signal flows for obtaining print data according to a first embodiment of the present invention.

FIG. 1 is a block diagram showing a construction and signal flows for obtaining print data to be transmitted to the printhead from inputted image data according to the first embodiment.

In FIG. 1, reference numeral 11 denotes an image memory for storing image data for one page, which is to be printed; 12, a pixel number calculation circuit for calculating the number of image data to be printed in unit of one page or in unit of a predetermined region; 13, a power consumption calculation and determination circuit for calculating a power consumption value based on a result of pixel number calculation and determining whether or not to perform thinning on pixels; 14, a thinning signal generation circuit for outputting a thinning signal according to a predetermined mask pattern based on a result of pixel thinning determination; and 15, an AND gate.

Reference numeral 20 denotes a received image data signal which is inputted; 21, a pixel number signal outputted by the pixel number calculation circuit; 22, a determination result signal indicating whether or not thinning is to be performed; 23, a thinning signal; 24, an image data signal read out of the image memory; and 25, a print data signal on which thinning is performed and transmitted to the printhead.

The received image data 20, which is inputted by a connected host apparatus, is stored in the image memory 11 and inputted to the pixel number calculation circuit 12. The pixel number calculation circuit 12 calculates the number of pixels printed in page unit or in unit of a predetermined region printed within a predetermined period of time, taking the installed position of each printhead 1 into consideration, and outputs the calculated result to the power consumption calculation and determination circuit 13.

The power consumption calculation and determination circuit 13 calculates a power consumption value based on the inputted number of pixels, determines whether or not the power consumption value exceeds a power consumption threshold value set by a CPU (not shown) or the like, and outputs the determined result to the thinning signal generation circuit 14.

The calculation of the power consumption value from the number of pixels is performed by calculating, for each printhead, the number of pixels to be printed in a predetermined time period or the number of pixels to be printed on one page, and then calculating the power consumption value for each printhead based on a power consumption value necessary for driving one printing element of a nozzle in each printhead. In a case where the power consumption value for the printing element is different in each printhead so that the amount of ink discharged from one nozzle in one discharge operation is made different in each printhead, the power consumption value for each printhead may be different if the number of pixels to be printed by each printhead is the same.

Further, it is preferable to calculate the power consumption value for each power supply unit (power supply voltage) involving a voltage drop. For example, if a power supply unit is provided for a printhead for black ink in addition to a power supply unit for the other printheads, the power consumption value is calculated for the printhead for black ink together with the calculation of the power consumption value for the other printheads.

It is noted that if the power consumption value is calculated based on the number of pixels to be printed in a predetermined time period, a plurality of printheads can be used to print the pixels on different printing media.

If the power consumption value exceeds the threshold value, the thinning signal generation circuit 14 outputs the thinning signal 23 in synchronization with the image data signal 24 read out of the image memory 11 in accordance with a predetermined mask pattern. The AND gate 15 executes AND operation between the image data 24 and thinning signal 23 for thinning printing pixels, and outputs the print data 25 to the printhead 1. The printhead 1 is driven according to the print data 25 obtained in the foregoing manner, thereby discharging ink onto a print medium for printing.

FIGS. 3A to 3D show examples of mask patterns employed by the thinning signal generation circuit 14. Note in FIGS. 3A to 3D, pixels indicated by shaded squares are thinned out.

Figure 3A:
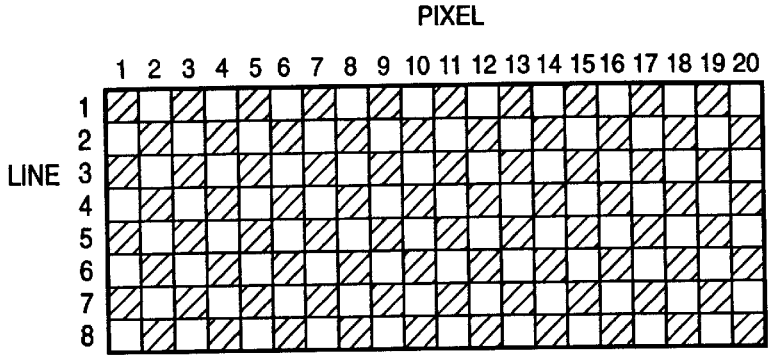
FIGS. 3A to 3D are views showing examples of mask patterns employed by an embodiment of the present invention.
Figure 3B:
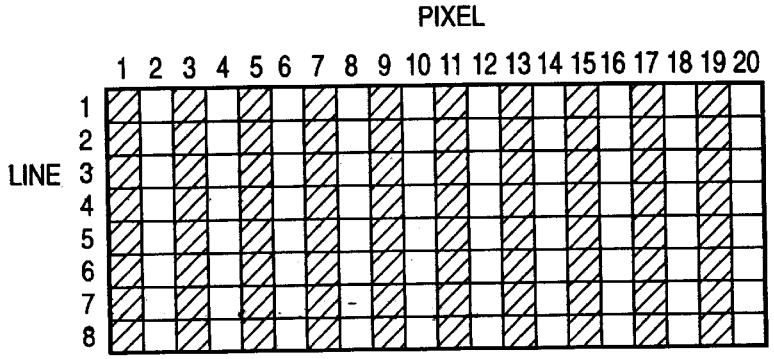
Figure 3C:
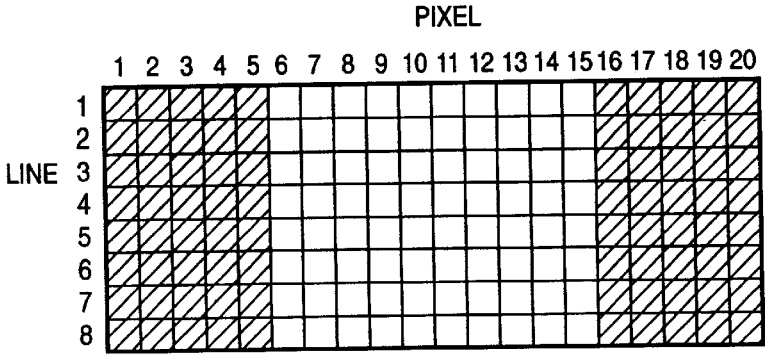
Figure 3D:
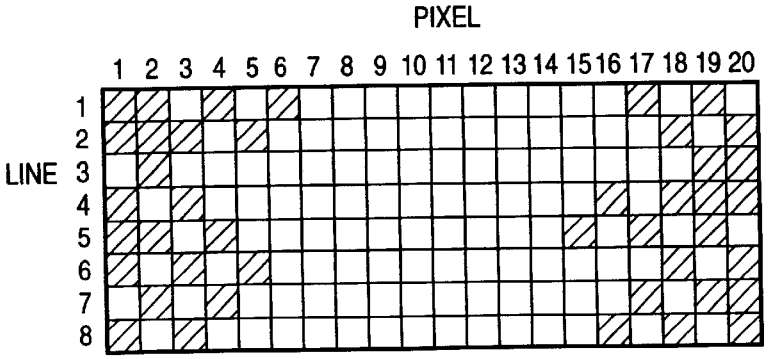

FIG. 3A is a checker mask pattern, where odd-numbered pixels and even-numbered pixels are alternately thinned out for each line. FIG. 3B is a stripe mask pattern, where odd-numbered pixels are always thinned out. FIG. 3C is a window-type mask pattern, where both ends of an image are thinned out but the center portion of the image is not thinned out. FIG. 3D is a center-emphasized-type mask pattern where a larger number of pixels are thinned out at ends of an image.

The mask pattern used by the thinning signal generation circuit 14 largely influences image quality of a print image. Therefore, it is important to select an appropriate mask pattern in correspondence with the type of image data (photographic image or character-oriented image, or whether or not data in the center area is to be emphasized). The apparatus may be configured such that the type of image data or a mask pattern is selectable by a user.

Further, the mask pattern can be changed in multistage, according to the power consumption value.

Figure 6:
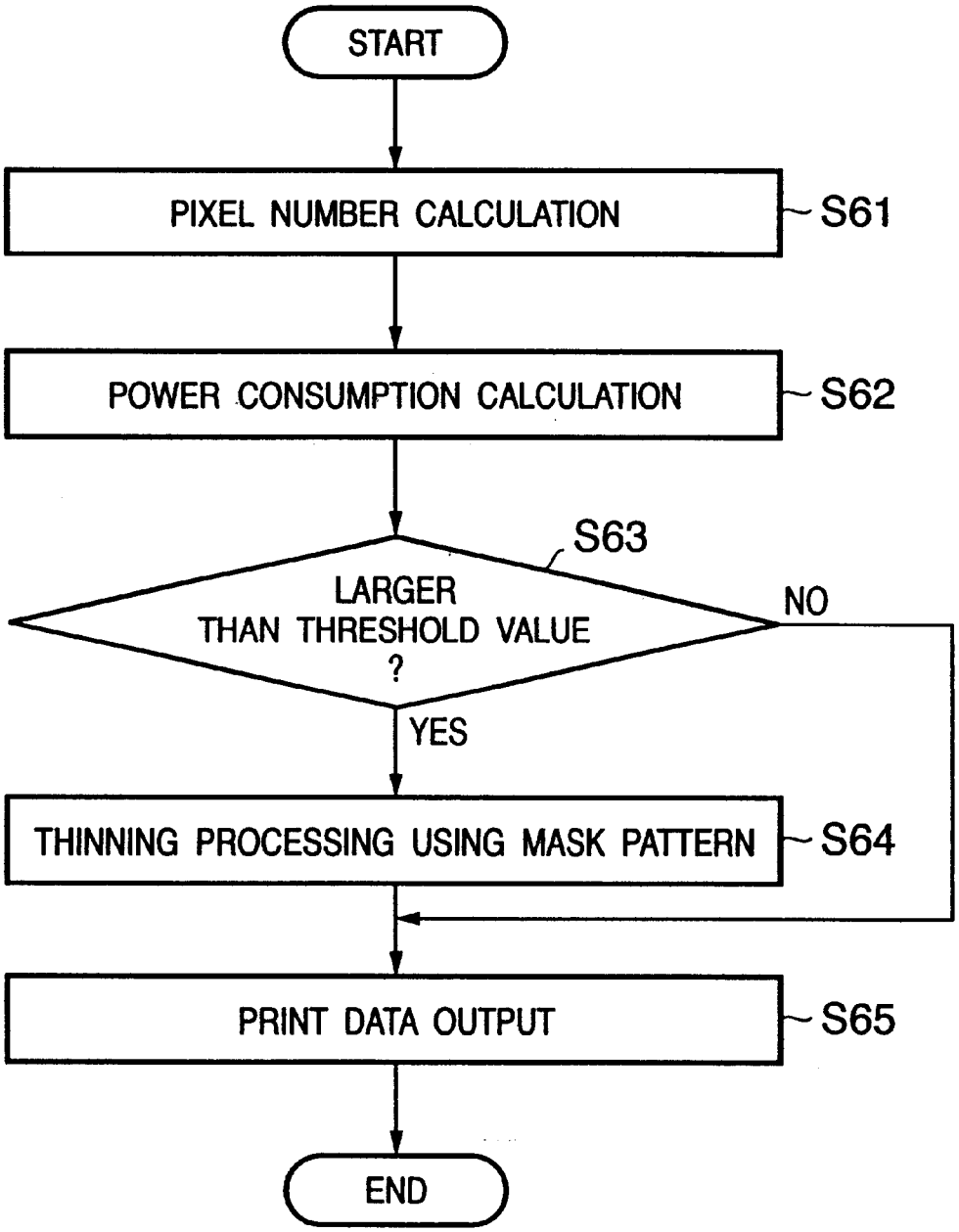
FIG. 6 is a flow chart of a power consumption reduction operation according to the first embodiment of the present invention.

Hereinafter, the power consumption reduction method is described once again with reference to the flowchart in FIG. 6.

Based on received image data, the number of pixels printed in page unit or in unit of a predetermined region printed within a predetermined period of time, is calculated taking the installed position of each printhead into consideration (step S61). Based on the number of pixels, a power consumption value is calculated (step S62).

It is determined whether or not the power consumption value exceeds a threshold value (step S63), and if so, pixel thinning is performed according to a predetermined mask pattern (step S64). Then, the data obtained by thinning processing is outputted to the printhead as print data (step S65). Meanwhile, if the power consumption value is equal to or less than the threshold value at step S63, the image data without being processed is outputted as print data at step S65.

As has been described above, the first embodiment enables to keep the maximum power consumption value under a predetermined value. Therefore, the maximum power suppliable by a power source can be set smaller than a conventional value, and a power source device can be downsized.

Accordingly, the entire printing apparatus can be downsized, decreased in weight, and lowered in cost. Furthermore, since the amount of heat generated in the printing operation is decreased, heat produced by a printing apparatus is decreased, thus reducing adverse effects on the environment of the apparatus, such as temperature increase and so forth. Moreover, less power consumption contributes to energy conversation.

[Second Embodiment]

Hereinafter, the second embodiment of the present invention is described. In the following description, components identical to that of the first embodiment will not be described, but characteristic components of the second embodiment will be described.

In the first embodiment, the pixel number calculation is performed at the time of storing the inputted image data in the image memory 11, whereas in the second embodiment, the pixel number calculation is performed at the time of reading data out of the image memory 11.

Figure 2:
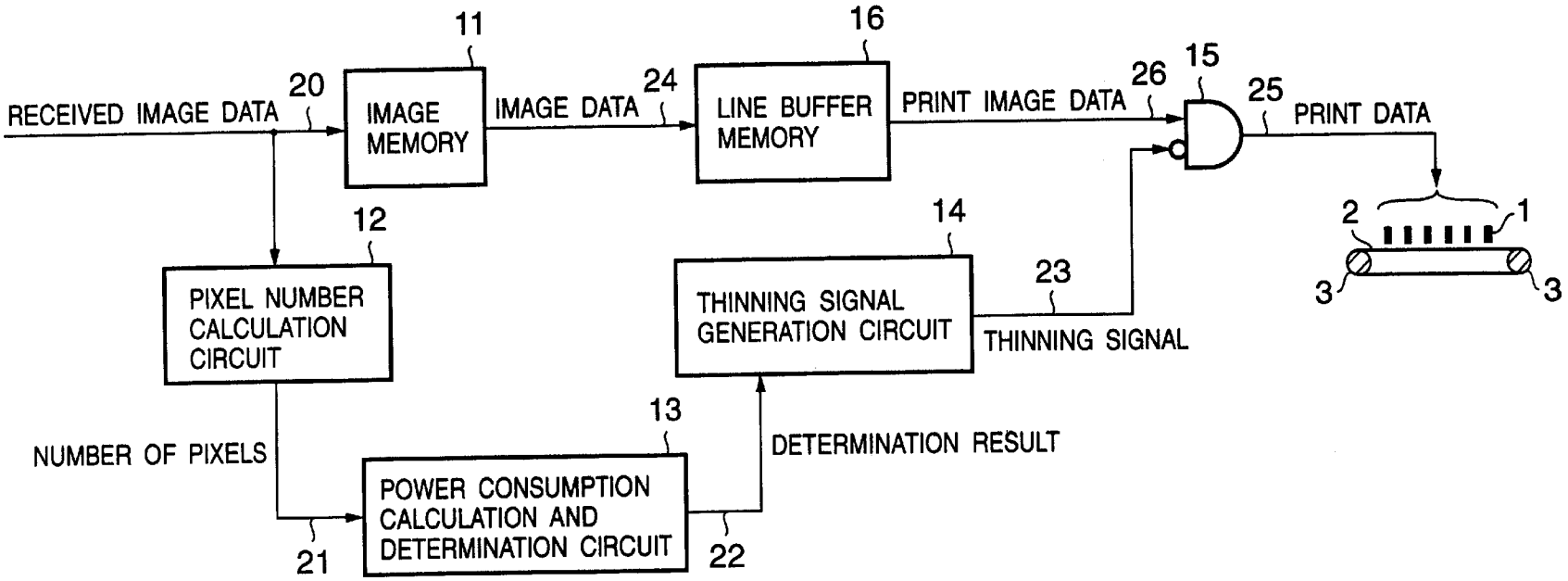
FIG. 2 is a block diagram showing a construction and signal flows for obtaining print data according to a second embodiment of the present invention.

FIG. 2 is a block diagram showing a construction and signal flows for obtaining print data to be transmitted to the printhead from inputted image data in the second embodiment.

Referring to FIG. 2, a configuration different from that of FIG. 1 is described. Reference numeral 16 denotes a line buffer memory temporarily storing image data included in a region where pixel number calculation is performed; and 26, print image data read out of the line buffer memory 16.

The received image data 20, which is inputted by a host apparatus, is temporarily stored in the image memory 11, and then read out in accordance with print timing of each printhead. The read out image data 24 is temporarily stored in the line buffer memory 26 and inputted to the pixel number calculation circuit 12. The pixel number calculation circuit 12 calculates the number of pixels, and outputs the calculated result to the power consumption calculation and determination circuit 13.

The power consumption calculation and determination circuit 13 calculates a power consumption value based on the inputted number of pixels, determines whether or not the power consumption value exceeds a power consumption threshold value set by a CPU (not shown) or the like, and outputs the determined result to the thinning signal generation circuit 14. If the power consumption value exceeds the threshold value, the thinning signal generation circuit 14 outputs the thinning signal 23 in synchronization with the print image data signal 26 read out of the line buffer memory 16 in accordance with a predetermined mask pattern. The AND gate 15 executes AND operation between the print image data 26 and thinning signal 23 for thinning printing pixels, and outputs the print data 25 to the printhead 1. The printhead 1 is driven according to the print data 25 obtained in the foregoing manner, thereby discharging ink onto a print medium for printing.

In the above-described first embodiment, the pixel number calculation needs to be performed while taking the discharge timing of each printhead into consideration. On the other hand, in the second embodiment, image data is read out of the image memory 11 at the same timing as the print timing of each printhead. Therefore, when the pixel number calculation is performed, it is not necessary to take the installed position of each printhead into consideration, and operation is simplified.

[Other Embodiments]

Although the above-described embodiments adopt an ink-jet printing apparatus which performs printing by an ink-jet method, it should easily be understood by those who are skilled in the art that the present invention is also applicable to a printer which adopts a printing method other than the ink-jet method and that similar effects can be attained.

In the printing apparatus using an ink-jet scheme, means (e.g., an electrothermal transducer, laser beam generator, and the like) for generating heat energy as energy utilized for execution of ink discharge, and causing a change in state of ink by the heat energy, can be used. According to this ink-jet printer and printing method, a high-density, high-precision printing operation can be attained.

As the typical arrangement and principle of the ink-jet printing system, those disclosed in, for example, U.S. Pat. Nos. 4,723,129 and 4,740,796, are preferable. The above system is applicable to either one of so-called on-demand type and continuous type systems. Particularly, in the case of the on-demand type, the system is effective because, by applying at least one driving signal, which corresponds to printing information and causes a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions of the invention described in U.S. Pat. No. 4,313,124 which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Application Laid-Open No. 59-123670 which discloses the arrangement using a slot common to a plurality of electrothermal transducers as a discharge portion of the electrothermal transducers, or Japanese Patent Application Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main unit and can receive ink from the apparatus main unit upon being mounted on the apparatus main unit, or a cartridge type printhead in which an ink tank is integrally arranged on the printhead itself, is applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independent of printing.

Furthermore, as a printing mode of the printer, not only a printing mode using only a primary color such as black or the like, but also at least one of a multicolor mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ ink which is solid at room temperature or less, or ink which softens or liquefies at room temperature, or ink which liquefies upon application of a printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, ink which is solid in a non-use state and liquefies upon heating may be used. In any case, ink which liquefies upon application of heat energy according to a printing signal and is discharged in a liquid state, ink which beings to solidify when it reaches a printing medium, or the like, is applicable to the present invention. In this case, ink may be situated opposite to electrothermal transducers while being held in a liquid or solid state in recess portions of a porous sheet or through-holes, as described in Japanese Patent Application Laid-Open No. 54-56847 or 60-71260. In the present invention, the above-mentioned film boiling system is most effective for the above-mentioned inks.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides the aforesaid functions according to the above embodiments being realized by executing the program codes which are read by a computer, the present invention includes a case where an OS (operating system) or the like working in the computer performs a part of or the entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, a CPU or the like contained in the function expansion card or unit performs a part of or the entire process in accordance with designations of the program codes and realizes functions of the above embodiments.

If the present invention is realized as a storage medium, program codes corresponding to the above mentioned flowchart (FIG. 6) are to be stored in the storage medium.

As many apparently widely different embodiments of the present invention can be made without departing from the spirit and scope thereof, it is to be understood that the invention is not limited to the specific embodiments thereof except as defined in the claims.

What is claimed is:

1. A printing apparatus including a plurality of full-line-type printheads, each having an array of printing elements corresponding to a width of a print medium, comprising:

pixel number calculation means for calculating a number of pixels to be printed in a predetermined region;

electric print power calculation means for calculating a value related to electric power to be supplied to the plurality of printheads based on the number of pixels in a case where a print operation is performed by using the plurality of printheads;

determination means for determining whether or not the value related to the electric power is larger than a predetermined value; and thinning means for thinning pixels to be printed in the predetermined region so as to keep the value related to the electric power under the predetermined value, in a case where said determination means determines that the value related to the electric power is larger than the predetermined value, wherein said pixel number calculation means calculates the number of pixels, even when the pixels are to be simultaneously printed on different printing media by the plurality of printheads.

2. The printing apparatus according to claim 1, further comprising image memory for storing input image data, wherein said pixel number calculation means calculates the number of pixels based on the image data inputted to the image memory.

3. The printing apparatus according to claim 1, further comprising image memory for storing input image data, wherein said pixel number calculation means calculates the number of pixels based on the image data read out of the image memory.

4. The printing apparatus according to claim 1, wherein said thinning means thins out pixels to be printed in accordance with a predetermined mask pattern.

5. The printing apparatus according to claim 4, wherein the mask pattern used by said thinning means is selectable from a plurality of mask patterns.

6. The printing apparatus according to claim 1, wherein the electric print power calculation means calculates the value related to the electric power, based on the number of pixels to be printed by the plurality of printheads and an electric power consumption value necessary to drive one printing element in each printhead.

7. The printing apparatus according to claim 6, wherein the power consumption value necessary to drive one printing element differs among the plurality of printheads.

8. The printing apparatus according to claim 1, wherein the electric print power calculation means calculates the value related to electric power for each unit of power supply.

9. The printing apparatus according to claim 1, wherein each printhead is an ink-jet printhead which performs printing by discharging ink.

10. The printing apparatus according to claim 9, wherein each printhead discharges ink by utilizing heat energy, and comprises a heat energy transducer for generating the heat energy to be applied to the ink.

11. The printing apparatus according to claim 1, wherein said electric print power calculation means calculates the value in consideration of positions of the plurality of printheads.

12. A power consumption reduction method of a printing apparatus, which has a plurality of full-line-type printheads, each having an array of printing elements corresponding to a width of a print medium, comprising:

a pixel number calculation step of calculating a number of pixels to be printed in a predetermined region;

an electric print power calculation step of calculating a value related to electric power to be supplied to the plurality of printheads based on the number of pixels;

a determination step of determining whether or not the value related to the electric power is larger than a predetermined value; and a thinning step of thinning pixels to be printed in the predetermined region so as to keep the value related to the electric power under the predetermined value, in a case where the value related to the electric power is determined to be larger than the predetermined value at said determination step, wherein said pixel number calculation step calculates the number of pixels, even when the pixels are to be simultaneously printed on different print media by the plurality of printheads.

13. The method according to claim 12, wherein the value related to the electric power is calculated based on the number of pixels to be printed by the plurality of printheads and an electric power consumption value necessary to drive one printing element in each printhead.

14. The method according to claim 13, wherein the electric power consumption value necessary to drive one printing element differs among the plurality of printheads.

15. The method according to claim 12, wherein the value related to electric power is calculated for each unit of power supply.

16. The method according to claim 12, wherein in said electric print power calculation step, the value is calculated in consideration of positions of the plurality of printheads.

17. A control program of a printing apparatus, which has a plurality of full-line-type printheads, each having an array of printing elements corresponding to a width of a print medium, said program having program codes corresponding to:

a pixel number calculation step of calculating a number of pixels to be printed in a predetermined region;

an electric print power calculation step of calculating a value related to electric power to be supplied to the plurality of printheads based on the number of pixels;

a determination step of determining whether or not the value related to the electric power is larger than a predetermined value; and a thinning step of thinning pixels to be printed in the predetermined region so as to keep the value related to the electric power under the predetermined value, in a case where the value related to the electric power is determined to be larger than the predetermined value at said determination step, wherein said pixel number calculation step calculates the number of pixels, even when the pixels are to be simultaneously printed on different print media by the plurality of printheads.

18. A storage medium storing a control program for a printing apparatus, which has a plurality of full-line-type printheads, each having an array of printing elements corresponding to a width of a print medium, said program having program codes corresponding to:

a pixel number calculation step of calculating a number of pixels to be printed in a predetermined region;

an electric print power calculation step of calculating a value related to electric power to be supplied to the plurality of printheads based on the number of pixels;

a determination step of determining whether or not the value related to the electric power is larger than a predetermined value; and a thinning step of thinning pixels to be printed in the predetermined region so as to keep the value related to the electric power under the predetermined value, in a case where the value related to the electric power is determined to be larger than the predetermined value at said determination steps, wherein said pixel number calculation step calculates the number of pixels, even when the pixels are to be simultaneously printed on different print media by the plurality of printheads.

* * * * *

UNITED STATES PATENT AND TRADEMARK OFFICE

CERTIFICATE OF CORRECTION

PATENT NO. : 6,648,441 B2
DATED : November 18, 2003
INVENTOR(S) : Naoi

It is certified that error appears in the above-identified patent and that said Letters Patent is hereby corrected as shown below:

Column 12,
Line 26, “steps,” should read -- step, --.

Signed and Sealed this

Twenty-seventh Day of July, 2004

JON W. DUDAS
*Acting Director of the United States Patent and Trademark Office*